US011712075B2

(12) United States Patent
Newman et al.

(10) Patent No.: US 11,712,075 B2
(45) Date of Patent: Aug. 1, 2023

(54) GLOVE WITH ELASTIC WRISTBAND

(71) Applicant: Rawlings Sporting Goods Company, Inc., St. Louis, MO (US)

(72) Inventors: Robert Newman, St. Peters, MO (US); Anton Sutovsky, St. Louis, MO (US)

(73) Assignee: RAWLINGS SPORTING GOODS COMPANY, INC., St. Louis, MO (US)

( * ) Notice: Subject to any disclaimer, the term of this patent is extended or adjusted under 35 U.S.C. 154(b) by 275 days.

(21) Appl. No.: 16/797,434

(22) Filed: Feb. 21, 2020

(65) Prior Publication Data

US 2020/0268076 A1 Aug. 27, 2020

Related U.S. Application Data

(60) Provisional application No. 62/862,311, filed on Jun. 17, 2019, provisional application No. 62/809,854, filed on Feb. 25, 2019.

(51) Int. Cl.

| | |
|---|---|
| ***A63B 71/14*** | (2006.01) |
| ***A41D 19/00*** | (2006.01) |
| ***A41D 31/18*** | (2019.01) |
| ***A41D 31/14*** | (2019.01) |

(52) U.S. Cl.

CPC ..... *A41D 19/0006* (2013.01); *A41D 31/145* (2019.02); *A41D 31/185* (2019.02); *A63B 71/143* (2013.01); *A41D 2500/10* (2013.01); *A63B 2209/14* (2013.01)

(58) Field of Classification Search

CPC .. A63B 71/143; A41D 19/006; A41D 19/001; A41D 19/0044; A41D 19/48

USPC ..... 2/162, 170

See application file for complete search history.

(56) References Cited

U.S. PATENT DOCUMENTS

| | | | | |
|---|---|---|---|---|
| 2,725,561 | A | 12/1955 | Blepp | |
| 3,528,107 | A * | 9/1970 | Rosenbaum | A63B 71/143 2/19 |
| 3,721,996 | A | 3/1973 | Nadorf | |
| 4,651,345 | A * | 3/1987 | Latina | A63B 71/143 2/19 |
| 4,847,915 | A | 7/1989 | Keene | |

(Continued)

FOREIGN PATENT DOCUMENTS

| | | | |
|---|---|---|---|
| AU | 708000 | B2 | 7/1999 |
| CN | 100423802 | C | 10/2008 |

(Continued)

*Primary Examiner* — Katherine M Moran

(74) *Attorney, Agent, or Firm* — Perkins Coie LLP

(57) ABSTRACT

A lightweight, breathable glove for baseball or softball is provided that generally includes a strap that extends over at least a portion of an opening in which a wearer may place his or her hand. The strap is at least partially made of an elastic material so that the strap can extend and contract. The glove may thus have a reduced weight to provide superior ease of use. Further, the conforming fit of the glove provides for enhanced control of the glove, which provides superior utility and performance for the glove, as well as other advantages. Alternatively, the glove may include a thong which may extend from the glove and may engage an elastic band at one of its ends. Thus, the elastic band may engage both the glove and the thong so that the size of the opening can increase and decrease due to the strap and/or elastic band.

16 Claims, 5 Drawing Sheets

(56) References Cited

U.S. PATENT DOCUMENTS

| | | | | |
|---|---|---|---|---|
| 4,991,234 | A * | 2/1991 | Greenberg | A41D 20/00 2/16 |
| 5,218,719 | A | 6/1993 | Johnson | |
| 5,226,190 | A | 7/1993 | Lynch | |
| 5,379,459 | A | 1/1995 | Williams, Jr. | |
| 5,557,803 | A | 9/1996 | Granich et al. | |
| 5,592,688 | A | 1/1997 | Laronge et al. | |
| 5,678,245 | A | 10/1997 | Rector et al. | |
| 6,253,382 | B1 | 7/2001 | Kleinert | |
| 6,415,444 | B1 | 7/2002 | Kleinert | |
| 6,516,470 | B1 | 2/2003 | Aoki | |
| 6,543,057 | B2 | 4/2003 | Béland et al. | |
| 6,634,029 | B1 | 10/2003 | Sullivano et al. | |
| 6,681,402 | B1 | 1/2004 | Bevier et al. | |
| 6,711,745 | B2 | 3/2004 | Sullivano et al. | |
| 6,721,960 | B1 | 4/2004 | Levesque et al. | |
| 6,772,441 | B2 | 8/2004 | Lucas, Jr. | |
| 6,868,553 | B2 | 3/2005 | Kleinert | |
| 6,941,578 | B2 | 9/2005 | Anderson | |
| 7,111,326 | B1 | 9/2006 | Sullivano et al. | |
| 7,574,749 | B2 | 8/2009 | Kogawa et al. | |
| 7,797,758 | B2 | 9/2010 | Keppler et al. | |
| 7,954,169 | B2 | 6/2011 | Rumer et al. | |
| 8,037,549 | B2 | 10/2011 | Saur et al. | |
| 8,181,276 | B2 | 5/2012 | Homer | |
| 8,262,594 | B2 | 9/2012 | Sandusky et al. | |
| 8,341,763 | B2 | 1/2013 | Geyer et al. | |
| 8,448,265 | B2 | 5/2013 | DuPont | |
| 8,490,215 | B2 | 7/2013 | Mueller et al. | |
| 8,646,112 | B2 | 2/2014 | Nix et al. | |
| 9,302,171 | B1 * | 4/2016 | Lacono | A63B 71/143 |
| 9,446,299 | B2 | 9/2016 | Hewitt et al. | |
| 9,456,643 | B2 | 10/2016 | Bruce et al. | |
| 9,662,561 | B1 | 5/2017 | Valenti | |
| 2003/0056273 | A1 * | 3/2003 | Kleinert | A63B 71/143 2/19 |
| 2011/0113521 | A1 | 5/2011 | Bradford | |
| 2011/0314582 | A1 | 12/2011 | Kleinert | |
| 2013/0041302 | A1 | 2/2013 | Williams | |
| 2015/0366277 | A1 | 12/2015 | Rabbeth, Jr. | |
| 2016/0345646 | A1 | 12/2016 | Marso | |
| 2016/0375344 | A1 | 12/2016 | Restko et al. | |
| 2017/0144055 | A1 * | 5/2017 | Aso | A41D 19/01588 |
| 2017/0238632 | A1 | 8/2017 | Aprile | |
| 2017/0368444 | A1 | 12/2017 | Fang | |
| 2018/0368491 | A1 | 12/2018 | Anunlke | |
| 2019/0008671 | A1 | 1/2019 | Hislop | |

FOREIGN PATENT DOCUMENTS

| | | | |
|---|---|---|---|
| KR | 200176008 | Y1 | 3/2000 |
| WO | 2017091824 | A1 | 6/2017 |
| WO | 2018142713 | A1 | 8/2018 |
| WO | 2019037068 | A1 | 2/2019 |

* cited by examiner

GLOVE WITH ELASTIC WRISTBAND

CROSS-REFERENCE TO RELATED APPLICATIONS

This application claims priority to U.S. Provisional Patent Application Ser. No. 62/809,854, filed on Feb. 25, 2019, entitled "Glove with Elastic Wristband," and U.S. Provisional Patent Application Ser. No. 62/862,311, filed on Jun. 17, 2019, entitled "Glove with Elastic Strap," the entire disclosures of which are incorporated herein by reference.

FIELD OF THE INVENTION

The present invention relates to sports equipment and, more particularly, to a glove for baseball or softball. The present invention is specifically directed to a lightweight glove for baseball or softball with a strap that provides a conforming fit to the wearer's hand.

BACKGROUND OF THE INVENTION

As best illustrated in FIG. 1, conventional gloves 100 for baseball or softball generally comprise a front panel 110 forming the front portion of the glove 100 and a back panel 115 forming the back portion of the glove 100. The front and back panels 110 and 115 are secured together at peripheral margins of the glove 100 by various fastening means to form a glove shell 120 having a top side 122, a bottom side 124, and sides 126. The fastening means may include, but are not limited to, stitching, cords, clasps, rivets, glue, and other fastening means. The glove shell 120 generally defines a thumb portion 136 and finger portions 138, shaped and sized so that a thumb and fingers may be inserted into the thumb portion 136 and fingers portions 138, respectively. The fingers portions 138 are conventionally joined by cross-bracing and form a conjoined finger region 140. The cross-bracing may include, but is not limited to, cords and the like. A web 142 is located between and secured to, by fastening means, the thumb portion 136 and fingers portion 138.

The front panel 110 has a central portion (not shown) forming a ball-catching pocket located above the bottom side 124 of the glove 100 and below the web 142 and the fingers portions 138. The bottom side 124 of the back panel 115 defines an opening 145 for receiving the wearer's hand and may further comprise an adjustable strap or thong 150 that extends across the opening 145. The adjustable strap or thong 150 typically comprises a hook-and-ring type fastener, a pull strap, a hook and loop strap, or the like. In some cases, to prevent the glove 100 from moving during use, the wearer is able to adjust the strap or thong 150 to selectively secure the same against the wearer's wrist to achieve a snug fit. The front and back panels 110 and 115 are preferably constructed of relatively thick, dense, and stiff material for structural integrity and shock absorbing purposes.

Gloves 100 constructed in conventional fashion are heavy, do not provide adequate means for securing the glove 100 to the wearer's hand during use, provide inferior handfeel, and lack adequate breathability. Generally, conventionally constructed gloves 100 are comprised entirely or mostly of leather and/or leather-like materials, which are generally relatively dense and stiff materials. Use of such dense material or materials in the construction of a glove for baseball or softball creates a relatively heavy glove, especially for gloves that comprise additional padding or lengths of materials, such as gloves for catchers or outfielders. Further, the use of stiff material to comprise back panel 115 and other elements of known gloves 100 generally inhibits the optimal fit and handfeel of the gloves 100. Although the leather or leather-like material of the front panel 110 of known gloves 100 may become less stiff over time through the process of breaking in the palm or forming the pocket of the glove 100, the material of the back panel 115 of known gloves 100 generally remains relatively stiff over the lifetime of the glove 100. Additionally, in general, the leather and/or leather-like materials are not adequately breathable and limit the flow of air onto and around the wearer's hand when the glove 100 is in use. For example, the back panel 115 of known gloves 100 comprises leather or leather-like material that has limited flexibility and does not permit adequate flow of air onto and around the wearer's hand.

Therefore, a need exists for a lightweight, breathable glove with a conforming fit and relaxed handfeel to optimize utility of the glove while also using fewer materials compared to known gloves.

SUMMARY OF THE INVENTION

The present invention relates to a lightweight, breathable glove for baseball or softball that generally comprises a strap that extends over at least a portion of an opening in which a wearer may place his or her hand. The strap is at least partially made out of elastic material(s) so that the strap can extend and contract, and further have a shape memory effect.

The strap therefore provides a conforming fit to the wearer's hand and a relaxed handfeel. The reduced weight of the glove provides superior ease of use, as well as other advantages. Further, the conforming fit of the glove provides for enhanced control of the glove, which provides superior utility and performance for the glove, as well as other advantages. Further yet, the breathable nature of the glove provides for improved wearer comfort. In general, the strap comprises an elastic material, a combination of elastic materials, or a combination of elastic and inelastic materials. The strap can be achieved by at least partially replacing the conventional adjustable strap or thong with the elastic material, combination of elastic materials, or combination of elastic and inelastic materials.

Alternatively, the glove may include a thong which may extend from the glove. The thong may be made out of an inelastic material. The thong may engage an elastic band at its other end. Thus, the elastic band may engage both the glove and the thong. Thus, the size of the opening can increase and decrease due to the strap and/or elastic band.

The objectives of this invention are as follows: (i) to provide a lightweight glove, (ii) to provide a glove with an improved fit for the wearer, (iii) provide a glove with improved breathability, and (iv) provide a glove that utilizes fewer materials compared to known gloves. Other advantages and objectives of the invention will become apparent from the following description with reference to the accompanying drawings.

BRIEF DESCRIPTION OF THE DRAWINGS

For a better understanding of the various embodiments of the present invention, reference may be made to the accompanying drawings in which.

Figure 1:
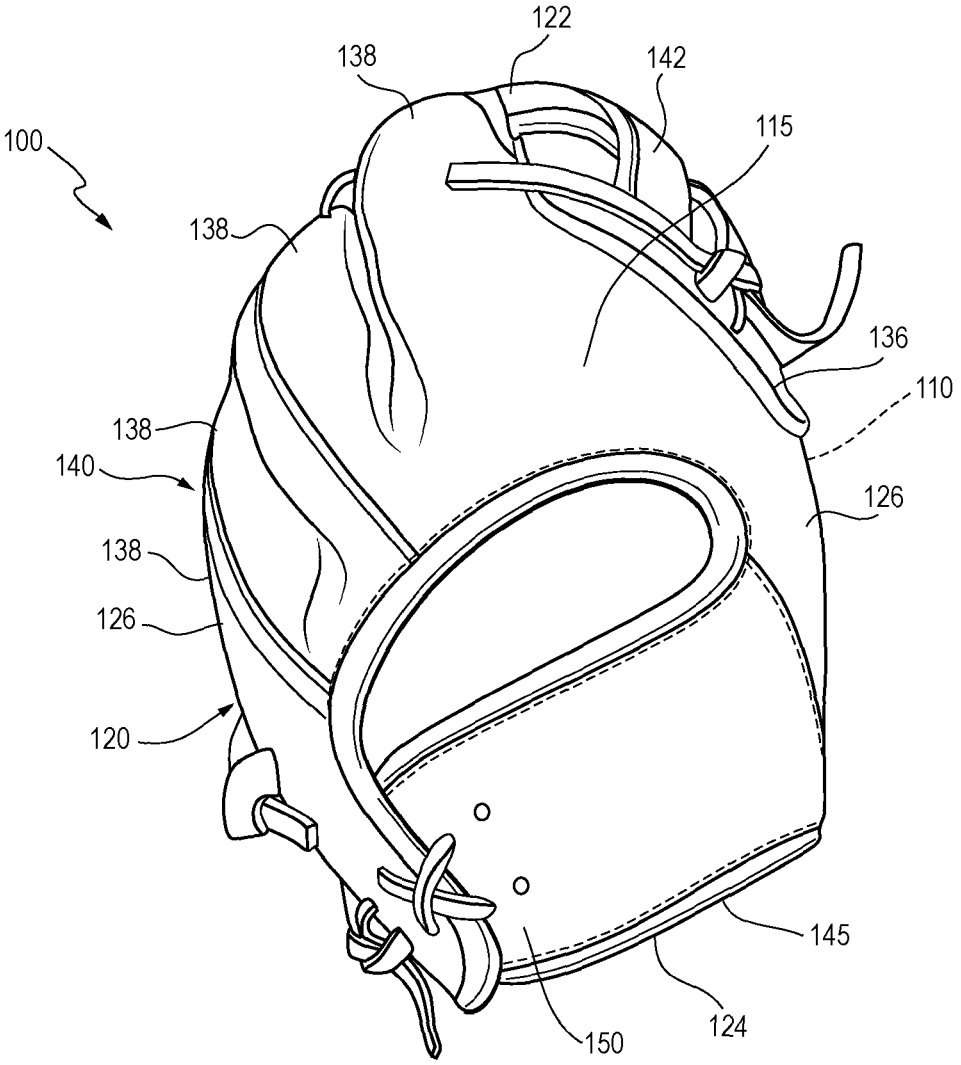
FIG. 1 PRIOR ART
FIG. 1 is a perspective representation and schematic depiction of a known glove.

While the disclosure is susceptible to various modifications and alternative forms, specific embodiments thereof are shown by way of example in the drawings and will herein be described in detail. It should be understood, however, that the drawings and detailed description presented herein are not intended to limit the disclosure to the particular embodiments disclosed, but on the contrary, the intention is to cover all modifications, equivalents, and alternatives falling within the spirit and scope of the present disclosure.

DETAILED DESCRIPTION OF THE INVENTION

The invention will now be described with reference to the drawing figures, in which like reference numerals refer to like parts throughout. For purposes of clarity in illustrating the characteristics of the present invention, proportional relationships of the elements have not necessarily been maintained in the drawing figures. It will be understood that any dimensions included in the figures are simply provided as examples and dimensions other than those provided therein are also within the scope of the invention.

The description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

One objective of the present invention is to provide a glove for baseball or softball with (i) a reduced weight, (ii) an improved fit and handfeel for the wearer, (iii) with improved breathability, and (iv) less materials compared to known gloves. Further, another objective of the present invention is to provide a glove for baseball or softball that is an improvement over known gloves for baseball or softball.

Figure 2:
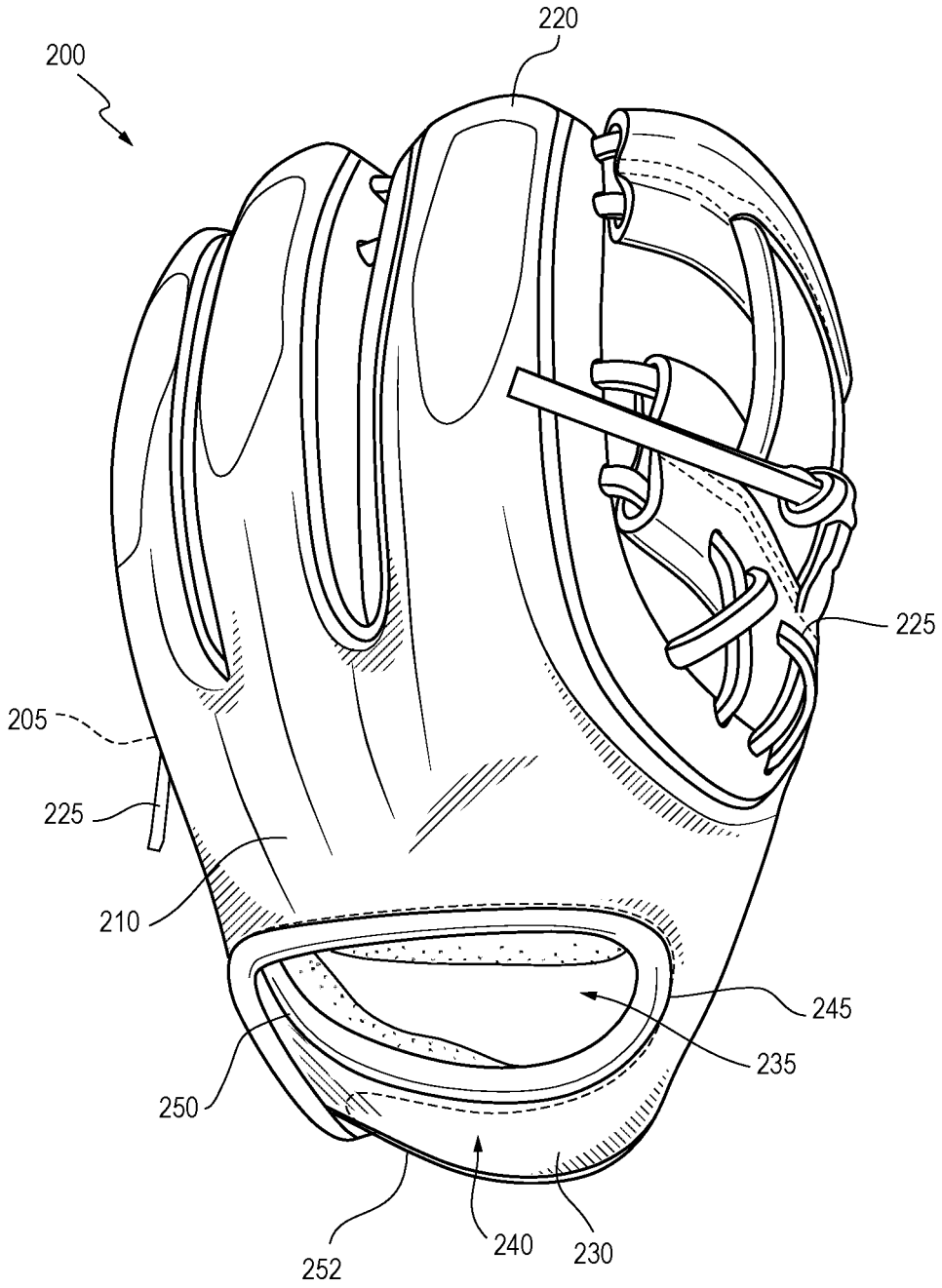
FIG. 2 is a perspective representation and schematic depiction of a first embodiment of a glove according to the teachings of the present invention.
Figure 3:
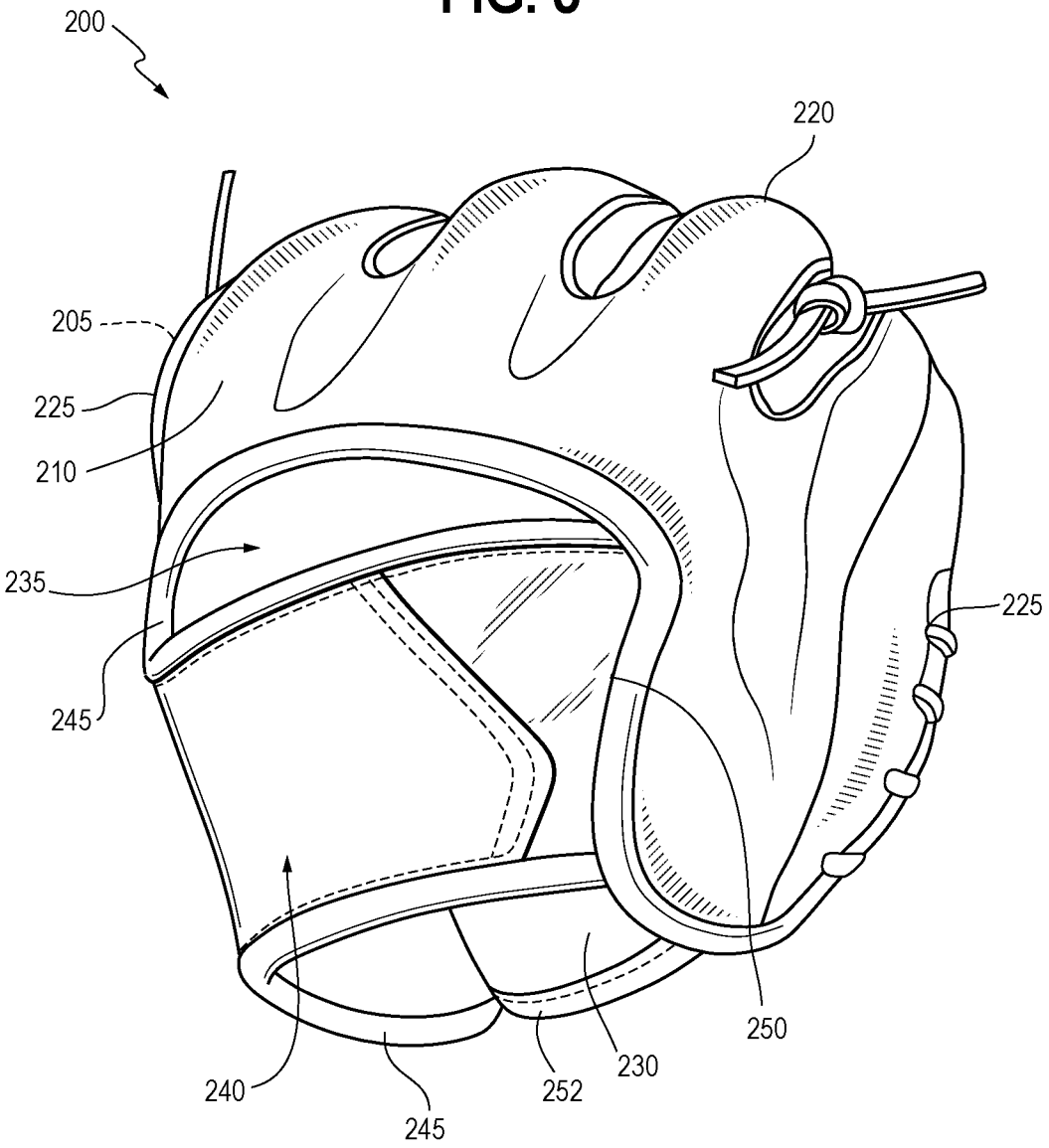
FIG. 3 is a perspective representation of the glove of FIG. 2.
Figure 4:
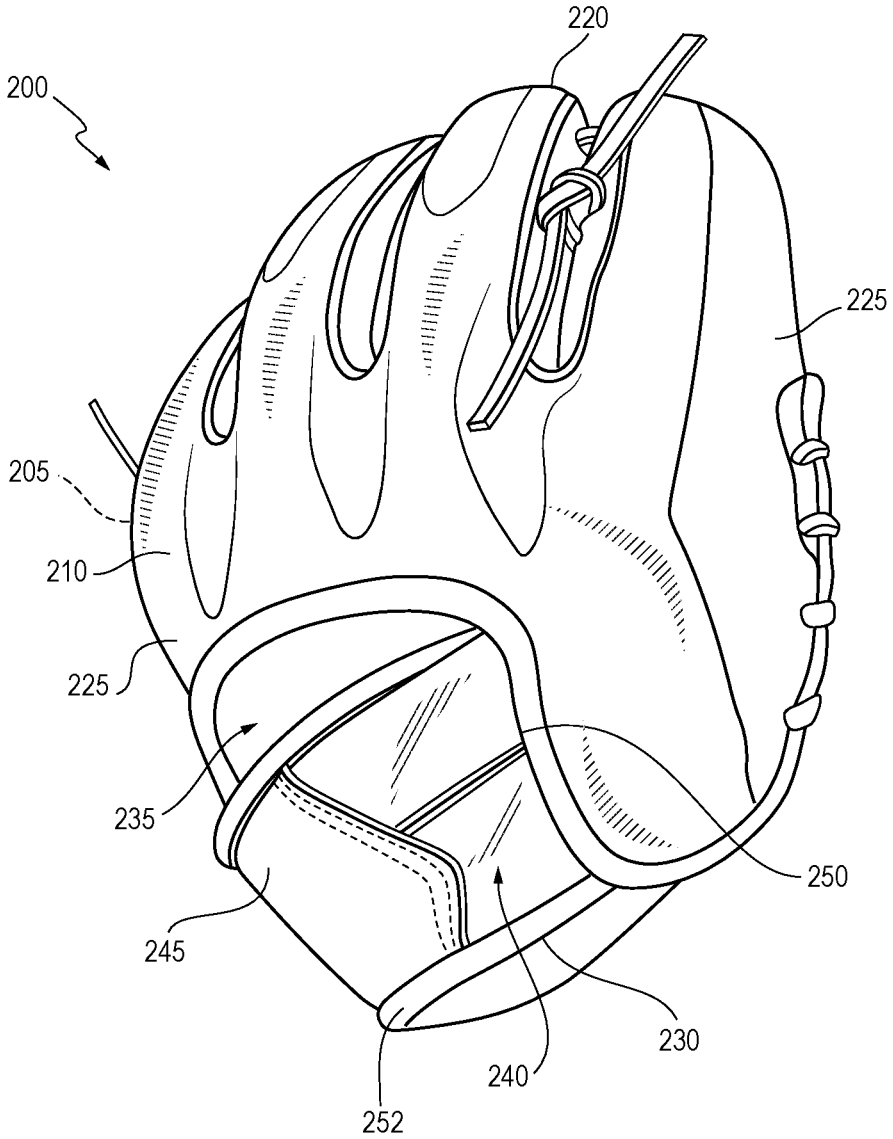
FIG. 4 is a perspective representation of the glove of FIGS. 2 and 3.

As illustrated in FIGS. 2-4, the present invention is directed to an improved lightweight glove 200 for baseball or softball. The glove 200 includes a front panel 205 and a back panel 210, where the front panel 205 forms the front side of the glove 200 and the back panel 210 forms the back side of the glove 200. The front panel 205 is the side of the glove 200 that is adjacent to a ball when the ball is caught by the glove 200, and the back panel 210 is opposite from the front panel 205. The front panel 205 and the back panel 210 are secured together at the peripheral margins of the glove 200 by at least one fastener (not shown) at a top portion 220 and both sides 225 of the glove 200, leaving an opening 230 for a user's hand to be inserted into the glove 200. The at least one fastener (not shown) may be stitching, cords, clasps, rivets, glue, and/or other fastening means as known in the art.

The back panel 210 includes a cut-out portion 235 which may be a U-like shape that extends from the opening 230 towards the top portion 220. In a first embodiment, the glove 200 may further include a strap 240 that may be a band or a strip that extends from a first cut-out side 245 towards a second cut-out side 250, and is positioned at a bottom portion 252 of the glove 200. However, in alternative embodiments, the strap 240 may include more than one piece of material and may also be different shapes and sizes. Thus, the opening 230 for receiving the wearer's hand may be at least partially defined by the strap 240 and the front panel 205.

The strap 240 may be made out of an elastic material, a combination of elastic materials, or a combination of elastic and inelastic materials. Further, the elastic material, combination of elastic materials, or combination of elastic and inelastic materials may be capable of repeated elastic deformation and has shape-memory effect. Thus, the strap 240 may stretch when pressure or force is used. The strap 240 can then contract and return to its former size and length when force or pressure is no longer being exerted upon the strap 240. Therefore, when a user desires to use the glove 200, the user may insert his or her hand through the opening 230. The opening 230 is preferably narrow enough or small enough that force is placed upon the strap 240, causing the strap 240 to stretch and expand when a hand is placed through the opening.

Once the hand has been inserted into the glove 200, the pressure or force exerted on the strap 240 is removed due to the smaller size and width of the wrist as compared to the hand. Without the force exerted on the strap 240 due to the size of the hand, the length of the strap 240 decreases. The size of the opening 230 therefore may contract to its previous size, where the strap 240 preferably provides a conforming fit to the wear's hand and/or wrist. Therefore the elastic material (or combination of elastic materials or combination of elastic and inelastic materials) of the strap 240 allows the opening 230 to be small enough so that the glove 200 has an improved fit and handfeel, but the opening 230 may stretch far enough that a hand may still be comfortably inserted into the glove 200.

In an alternative embodiment, the strap 240 may include a tension adjusting mechanism (not shown) to further adjust the fit and handfeel of the glove 200. Such an alternative to the strap 240 may extend from the first cut-out side 245 towards the second cut-out side 250, which may include a connection point (not shown). The connection point allows the strap 240 to engage the tension adjusting mechanism. The tension adjusting mechanism may be a series of snap buttons located and positioned at varying distances from the second cut-out side 250, a ratcheting system, or interchangeable straps.

In embodiments where the tension adjusting mechanism is a series of interchangeable straps, the strap 240 may include a connection point which engages with the interchangeable strap. The glove 200 further may then include a connection point (not shown) located at the second cut-out side 250. The interchangeable strap could engage both the strap 240 and the second cut-out side 250, thereby increasing or decreasing the tension of the strap 240 depending on the length of the interchangeable strap used. In yet another embodiment, the entire strap 240 may be disengaged from the glove 200 and replaced with an interchangeable strap. In yet another embodiment, the tension adjusting mechanism may be located on the first cut-out side 245 instead of the second cut-out side 250.

Figure 5:
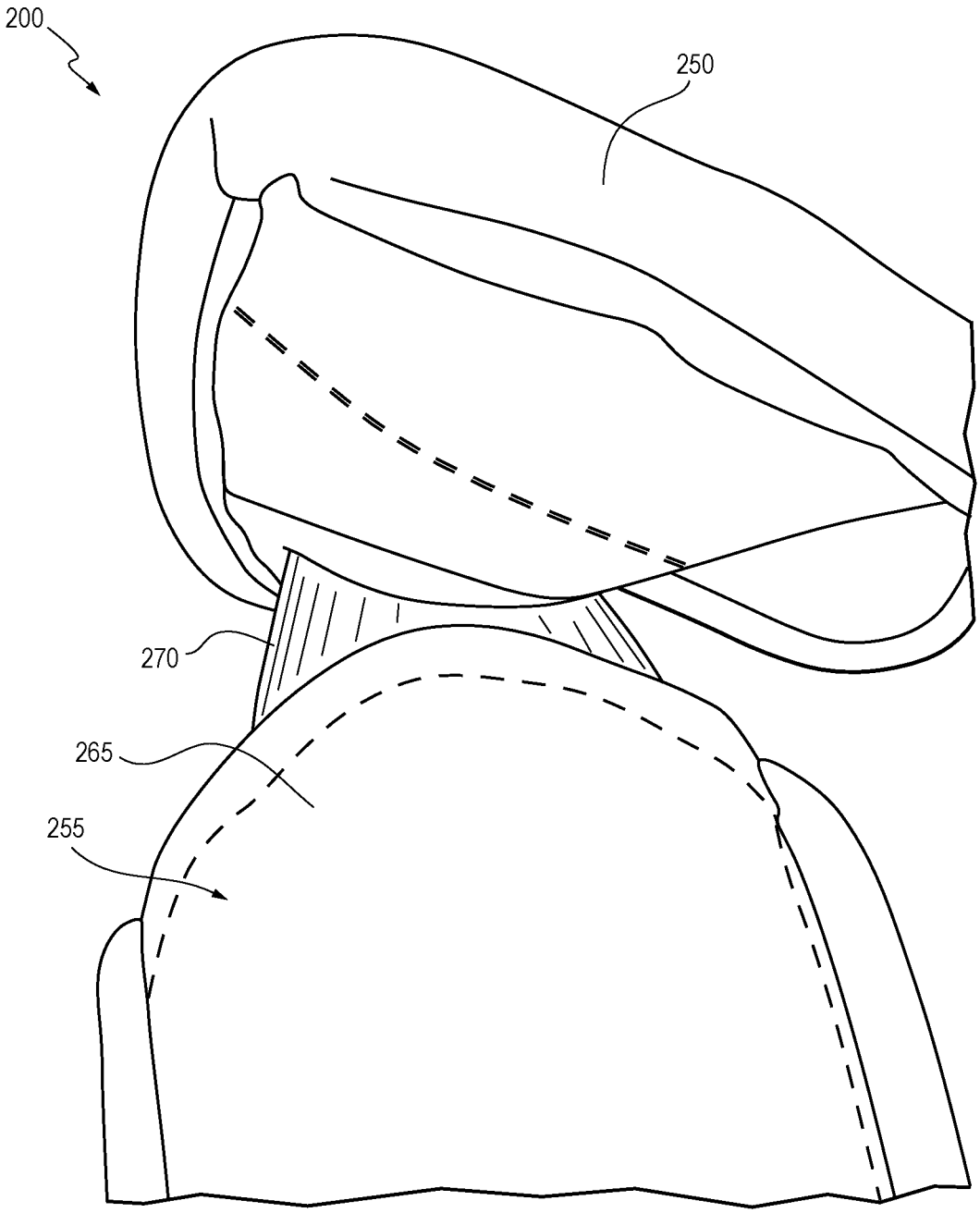
FIG. 5 is a perspective representation of a second embodiment of a glove.

In yet another alternative embodiment and as seen in FIG. 5, the glove 200 may include a thong 255 that is attached to the first cut-out side 245 (shown in FIGS. 2-4) and extends towards a second cut-out side 250 of the cut-out 235 (shown in FIGS. 2-4). A first thong end (not shown) of the thong 255 may extend from the first cut-out side 245 towards the second side 250 of the cut-out 235, while a second strap end 265 is adjacent to and abuts an elastic band 270. The elastic band 270 is adjacent to and abuts the second cut-out side 250. Thus, the thong 255 and the elastic band 270 of the glove 200 may together extend across the opening 230 (shown in FIGS. 2-4).

The thong 255 may be made out of an inelastic material. The thong 255 therefore does not stretch. The elastic band 270, however, may be made out of elastic material, or a combination of elastic and inelastic material or materials. Similarly to the first embodiment, the elastic material of the elastic band 270 allows the size of the opening 230 to increase with pressure or force and decrease once the force or pressure has been removed. Thus, the size of the opening 230 of the glove 200 may increase so that a hand may fit though the opening 230, as well as decreases once the hand has passed through the opening 230. The glove 200 may further include a tension adjustment mechanism, as described above, to further includes the adjustability and increased handfeel of the glove 200.

Thus, with respect to the embodiments depicted by FIGS. 2-5, the wearer inserts his or her hand into the opening 230, and his or her respective palm and fingers are received in the glove 200. When the wearer inserts his or her hand into the glove 200, the wearer's wrist and hand selectively displaces the strap 240 or thong 255 and elastic band 270, which both return to their intended position relative to the glove 200 once the wearer's hand is at least mostly received into the glove 200, via the elastic and memory-shape nature of the elastic material. Once the wearer's hand is at least mostly received into the glove 200, the elastic material causes the strap 240 or combination of the thong 255 and elastic band 270 to compressingly secure the wrist and hand of the wearer, such that the use of an adjustable strap or thong 150 for selectively securing the glove 100 to the wearer's hand is not necessary. It will be understood that the glove 200 may comprise a strap 240 or thong 255 and elastic strap 270 for purposes other than compressingly securing the wrist and hand of the wearer.

Thus, in the embodiments described above, the glove 200 uses either the strap 240 or the thong 255 and elastic band 270 to provide a conforming fit to the wearer's hand and a relaxed handfeel. The strap 240 and elastic band 270 generally comprises, at least in part, a lightweight elastic material, a combination of elastic materials, or a combination of elastic and inelastic materials, which may also be breathable and may generally comprise a flexible knit or mesh-like material. Further, the elastic material, combination of elastic materials, or combination of elastic and inelastic materials may be capable of repeated expansion and contraction and has shape-memory effect. The strap 240, thong 255, and elastic band 270 may further comprise breathable materials for purposes of facilitating the flow of air onto and/or around the wearer's hand when the glove 200 is in use.

In a preferred embodiment, the elastic material, combination of elastic materials, or combination of elastic and inelastic materials of the strap 240 and elastic band 270 may serve the general purpose of the prior art adjustable strap or thong 150, while also providing improved and desirable material characteristics for the same. Additionally, the strap 240 and combination of the thong 255 and the elastic band 270 are suitable to accommodate various hand and wrist sizes. In this way, the strap 240 and combination of the thong 255 and elastic band 270 provide a superior, accommodating fit and relaxed handfeel when compared to known gloves 100 for baseball or softball. The strap 240 or combination of the thong 255 and elastic band 270 may replace other fastening means (or used in combination) that would be traditionally used to attach such inelastic material to a conventional glove 100.

In these embodiments of the present invention, the present invention may provide for (i) the substitution of lightweight material in place of dense leather or leather-like material of conventional gloves, (ii) an improved conforming fit to the wearer's hand and a relaxed handfeel, and (iii) increased breathability onto and around the wearer's hand when the glove is in use, while being at least as adequately suitable as existing materials comprising adjustable straps, thongs, or back panels of known gloves for baseball or softball.

Although the present invention is discussed and depicted here as particular embodiments, it will be understood that the present invention can apply to all gloves for baseball or softball, including, but not limited to, gloves or mitts for pitchers, catchers, first basemen, infielders, outfielders, and the like.

From the foregoing, it will be seen that the various embodiments of the present invention are well adapted to attain all the objectives and advantages hereinabove set forth together with still other advantages which are obvious and which are inherent to the present structures. It will be understood that certain features and sub-combinations of the present embodiments are of utility and may be employed without reference to other features and sub-combinations. Since many possible embodiments of the present invention may be made without departing from the spirit and scope of the present invention, it is also to be understood that all disclosures herein set forth or illustrated in the accompanying drawings are to be interpreted as illustrative only and not limiting. The various constructions described above and illustrated in the drawings are presented by way of example only and are not intended to limit the concepts, principles and scope of the present invention.

Many changes, modifications, variations and other uses and applications of the present invention will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A glove for baseball or softball, the glove comprising:

a front panel;

a back panel, wherein the back panel includes a cut-out portion having a first cut-out side and a second cut-out side;

a web positioned between, and attached to, a thumb portion and a finger portion of the glove; and a strap; wherein:

the front panel and the back panel each have a top portion and first and second side portions;

the front panel and the back panel are affixed to each other at their respective top portions, first side portions, and said second side portions;

the front panel and the back panel are not connected at respective bottom portions thereof, forming an opening therebetween for receiving a user's hand;

the cut-out portion extends from the opening toward the top portion of the back panel;

the cut-out portion extends between the first cut-out side and the second cut-out side;

the strap extends from the first cut-out side toward the second cut-out side, wherein the strap defines at least a portion of the opening;

the strap comprises an elastically deformable portion and an inelastic portion adjacent to the elastically deformable portion;

the elastically deformable portion connects the strap to the first cut-out side;

the inelastic portion connects the strap to the second cut-out side; and the opening increases and decreases in size as the elastically deformable portion of the strap expands and contracts.

2. The glove of claim 1, wherein the strap comprises a breathable material.

3. The glove of claim 1, wherein the strap comprises a knit material.

4. The glove of claim 1, wherein the strap comprises a mesh-like material.

5. The glove of claim 1, wherein the strap has a shape memory effect.

6. A glove for baseball or softball, the glove comprising:

a front panel;

a back panel, wherein the back panel includes a cut-out portion having a first cut-out side and a second cut-out side;

a web positioned between, and attached to, a thumb portion and a finger portion of the glove; and a strap extending across the cut-out portion, wherein the strap comprises a first portion capable of selectively expanding and contracting, and a second portion adjacent to the first portion; wherein:

the front panel and the back panel each have a top portion and first and second side portions;

the front panel and the back panel are affixed to each other at their respective top portions, first side portions, and said second side portions;

the front panel and the back panel are not connected at respective bottom portions thereof, forming an opening therebetween for receiving a user's hand; and the first portion of the strap is positioned between the second portion and the second cut-out side.

7. The glove of claim 6, wherein the glove includes a tension adjusting mechanism for adjusting a width of the opening.

8. The glove of claim 6, wherein the strap comprises a thong and an elastic band.

9. The glove of claim 6, wherein the strap has a shape memory effect.

10. A glove for baseball or softball, the glove comprising:

a front panel;

a back panel, wherein the back panel includes a cut-out portion having a first cut-out side and a second cut-out side;

a web positioned between, and attached to, a thumb portion and a finger portion of the glove;

a thong; and an elastic band capable of expanding and contracting; wherein:

the front panel and the back panel each have a top portion and first and second side portions;

the front panel and the back panel are affixed to each other at their respective top portions, first side portions, and said second side portions;

the front panel and the back panel are not connected at respective bottom portions thereof, forming an opening therebetween for receiving a user's hand;

the cut-out portion extends from the opening toward the top portion of the back panel;

the thong and the elastic band together extend across at least part of the cut-out portion; and the thong is positioned between the elastic band and the first cut-out side.

11. The glove of claim 10, wherein at least one of the elastic band or the thong comprises a breathable material.

12. The glove of claim 10, wherein at least one of the elastic band or the thong comprises a knit material.

13. The glove of claim 10, wherein at least one of the elastic band or the thong is comprises a mesh-like material.

14. The glove of claim 10, wherein at least one of the elastic band or the thong further comprises an inelastic material.

15. The glove of claim 10, wherein the elastic band has a shape memory effect.

16. The glove of claim 10, wherein the glove includes a tension adjusting mechanism for adjusting a size of the opening.

* * * * *